United States Patent [19]

Bailey

[11] 4,253,673

[45] Mar. 3, 1981

[54] PIECE FOR CATCH AND TOSS GAME

[76] Inventor: Dennis B. Bailey, P.O. Box 10653, Phoenix, Ariz. 85064

[21] Appl. No.: 36,087

[22] Filed: May 4, 1979

Related U.S. Application Data

[63] Continuation of Ser. No. 778,853, Mar. 18, 1977, abandoned.

[51] Int. Cl.[3] ..... A63B 65/00

[52] U.S. Cl. ..... 273/428; 84/477 B; 206/579; 273/411

[58] Field of Search ..... 273/95 R, 95 H, 84, 273/67 R, 67 DA, 67 DB, 106 R, 317, 411, 428; 84/477 B; 206/579, 231, 476, 477, 478, 479, 483

[56] References Cited

U.S. PATENT DOCUMENTS

| | | | |
|---|---|---|---|
| 754,558 | 3/1904 | Greves | 206/479 |
| 2,021,070 | 11/1935 | Levine | 206/579 |
| 2,680,514 | 6/1954 | St. Pierre | 206/579 |
| 3,662,081 | 9/1972 | Hale et al. | 84/477 B |
| 3,861,683 | 1/1975 | Henry | 273/106 R |
| 3,968,968 | 7/1976 | Peterson | 273/95 H |
| 4,021,041 | 5/1977 | Goldfarb et al. | 273/106 R X |

FOREIGN PATENT DOCUMENTS

| | | | |
|---|---|---|---|
| 599727 | 3/1948 | United Kingdom | 273/95 H |

*Primary Examiner*—William H. Grieb
*Attorney, Agent, or Firm*—Gregory Nelson

[57] ABSTRACT

A game or sport utilizing a baton which is thrown and caught between players in a prescribed manner. The baton has a blade and a handle and may be provided with a high visibility protective covering and protective end tips. The complete assembly includes a field assembly using a flexible member or rope having color coded markers and ground stakes for establishing the proper playing areas and boundaries.

2 Claims, 9 Drawing Figures

PIECE FOR CATCH AND TOSS GAME

This is a continuation of application Ser. No. 778,853, filed Mar. 18, 1977 now abandoned.

The present invention relates to a sport or game and more particularly relates to a sport or game in which specially designed baton is thrown or tossed between players with the object of the game being to throw and catch the object in a prescribed manner.

Games and sports involving objects which are thrown or tossed between players are numerous. Such games usually involve a ball of some type which is simply tossed back and forth between the players. This type of game or sport, while popular, is relatively simple and does not involve a great measure of skill. Further, such a simple toss game lacks the element of competitiveness so that participants quickly lose interest in such a game. Further, these games do not fully develop eye, hand and body coordination of the participants.

Other games involving tossed or thrown objects such as jai lai, handball and similar games require extreme athletic ability beyond the capability of many players. Further, these games do not lend themselves to participants of all ages and require specially constructed courts.

Another game of recent vintage is a game sold under the trademark "FRISBEE". This game has gained much popularity because of its simplicity and its broad appeal to participants of all ages. However, with the possible exception of the game designated "FRISBEE", there has been a paucity of games or sports in which an object is tossed which have been recently developed.

Accordingly, it is the principal object of the present invention to provide a novel game or sport in which an object is tossed between players. The game of the present invention can accommodate participants of all ages and can be played on various skill levels from novice to expert. A minimum of space is required for the game and the game can be played either indoors or outdoors. The object and rules of the game are relatively simple and a minimum of equipment is needed. The game can be played as a recreational sport for exercise or relaxation or can be played in a highly sophisticated serious competitive game.

Briefly, in its simplest form the present invention comprehends a game utilizing a baton-like object which is specially constructed. The baton is elongated and has a blade and handle section. Protective tips are provided at opposite ends of the baton. The baton is thrown between players in a prescribed manner and must be caught in a prescribed manner with the object of the game being to eliminate, "terminate or annihilate" your opponent through tactical and skillful manipulations of the baton. The game of the present invention can be played in a minimum space by participants of all ages. The game requires a minimum of two players and can be played with multiple players in odd or even numbers. The invention also includes a field assembly in the form of a rope or nylon or other material which carry stakes on eyelets on the stakes. The nylon rope carries appropriate identifications markers at locations along the rope so that the rope can be conveniently layed out in a specified pattern with an elongate, rectangular "dead" space extending between two polygonal areas termed "beaten" zones. The players stand in the beaten zones when participating in the game. In another aspect of the invention, a special protector tip can also be added to the baton for competition between younger players. The stakes can be provided with a long or short shank depending on the type of area in which the game is to be played. The entire game assembly including baton, stakes and field layout rope can be provided in a kit encased in an appropriate case or quiver. Another form of field assembly for use on hard playing surfaces such as gymnasium floors involving two polygonal panels interconnected by flexible members may also be provided.

The above and other objects and advantages of the present invention will become more apparent from the following description, claims and drawings in which:

Figure 5:
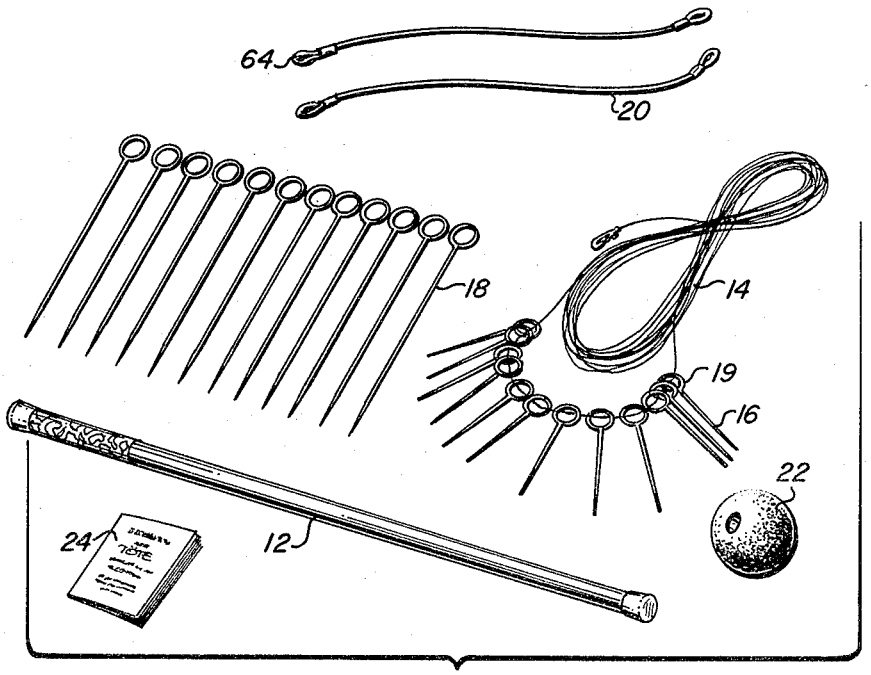
FIG. 5 illustrates the various components of the game of the present invention.

The present invention comprehends a game or sport which utilizes a baton which is tossed between two or more players. FIG. 5 illustrates the basic components of the game of the present invention which includes a baton 12 and field marker rope 14 with attached stakes 16 for laying out a field. The stakes have loops or eyelets 19 through which the rope 14 is threaded. The longer stakes 18 may be substituted for stakes 16 when the game is played on a beach or on soft terrain. Alignment markers 20 are also used in laying out the field each having loops 64 at either end. A resilient ball 22 can be affixed to on end of the baton 12 when the game is played by younger players. The complete game also includes a set of rules 24 and, as seen in FIGS. 2 and 3, may be provided in an appropriate quiver or case 25.

As will be explained in more detail hereafter, the baton 12 is thrown or tossed between players in the prescribed manner and must be caught in a prescribed manner. The object of the game is to eliminate, terminate or annihilate the opposing player or players through the manipulations of the baton. The terms "eliminate", "terminate" and "annihilate" will be explained hereafter. The baton is the principal playing piece in the game.

Figure 1:
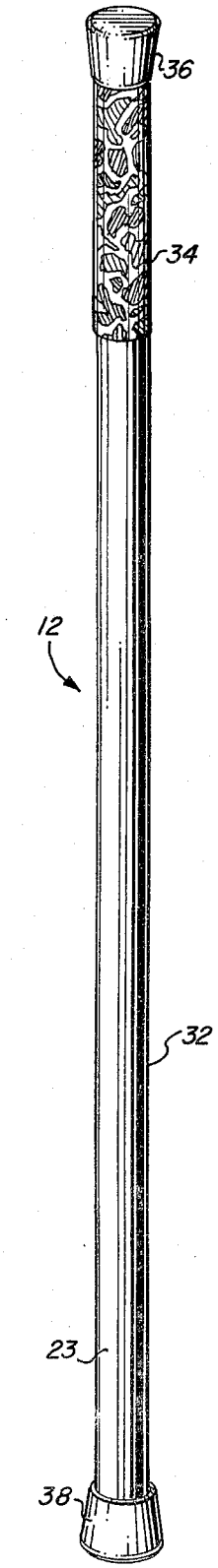
FIG. 1 is a perspective view of one form of the baton utilized in the game of the present invention.

The baton 12 is best illustrated in FIG. 1. The baton 12 includes an elongate, cylindrical body 23 including a blade member 32 having a handle 34 at one end. The body 23 can be fabricated from many suitable materials such as a hardwood dowel. The blade 32 is preferably appropriately finished and handle 34 may be of fabric such as a synthetic suede. Resilient protective tips 36 and 38 are provided at the handle and blade on the baton 12. Although the size of the baton may vary, it is preferred the baton have an approximate overall length of thirty-two inches with the length of the handle being approximately six inches and the baton diameter being one and one-quarter inches. The balance point or center of gravity of the baton 12 is located at the approximate longitudinal mid-point of the baton.

Figure 2:
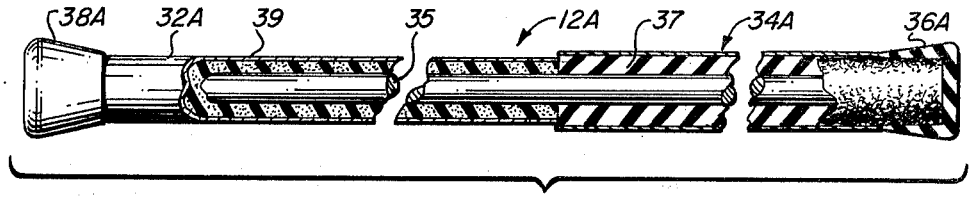
FIG. 2 is an elevational view partly in section of another embodiment of the baton.
Figure 3:
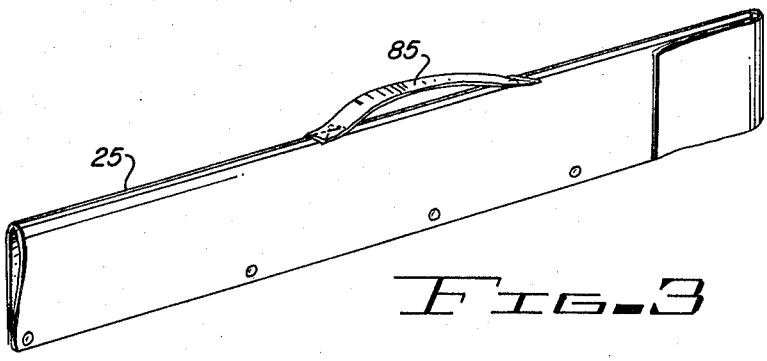
FIG. 3 is a perspective view of the quiver or case used for carrying and storing the various components of the game of the present invention.

FIG. 2 illustrates an alternate embodiment of the baton designated by the numeral 12A. In this and other figures, similar elements are identified with common numerals carrying an appended letter for differentiation. Baton 12A is similar in size to baton 12 shown in FIG. 1 but is constructed having an elongate tubular member 35 which may be neoprene, PVC or other material. The body tubular member 35 is covered or wrapped with a layer of padding 37 which may be of resilient sponge or foam. The blade portion 32A of the baton 12A is encased in an appropriate fabric sleeve 39 such as a nylon which, for example, might be a high visibility dayglow orange or green. The handle portion 34A of the baton 12A is covered with a sleeve of suede or other fabric such as nylon or canvas. Appropriate protective tips 38A and 36A are provided at the blade and handle end of the baton. The baton shown in FIG. 2 is designed for general use in that the padded body minimizes the possibility of injury. The high visibility blade portion facilitates proper catching of the baton. The unpadded embodiment shown in FIG. 1 is for the more skilled or advanced player.

Figure 6:
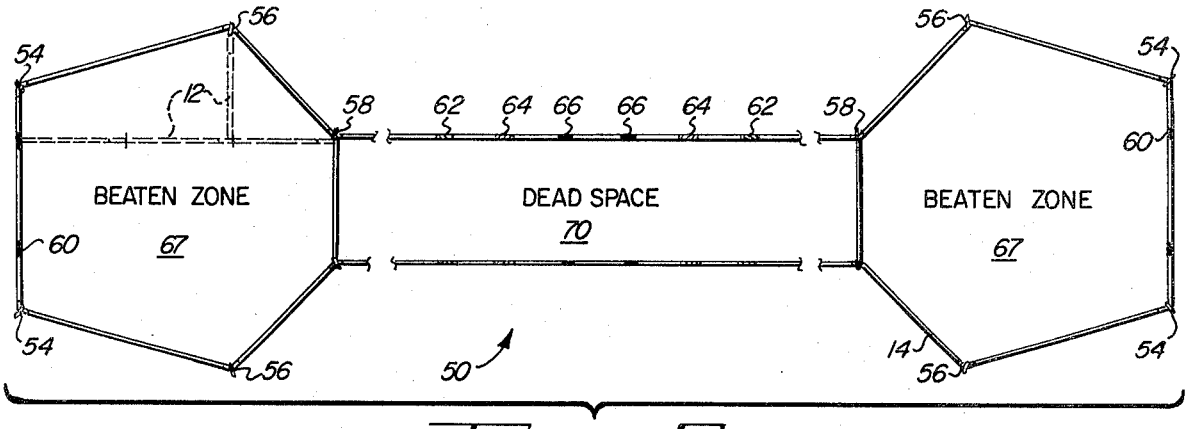
FIG. 6 is a plan view illustrating a field layout for two players.

The game of the present invention can be played in its simplest form by two participants standing a prescribed distance apart. However, the game is designed to be properly played on a field layout such as is shown in FIG. 6 and designated by the numeral 50. For portability and ease of transportational layout, the field can be set-up using flexible rope 14 which is secured to a playing surface by stakes 16 or 18. To facilitate setting-up the field for the game, the rope 14 which may be of high quality nylon is appropriately color coded at selected locations. The color coding may be, for example, in the form of cylindrical ferrules secured about the rope. Ferrules 54 may be flue, ferrules 56 green, ferrules 58 red and ferrules 60 black. Color coding may be also played on the field layout rope 14 at locations 62, 64 and 66 appropriately coded brown, gray and black. The field is layed in FIG. 6 by uncoiling the rope 14 shown in FIG. 5. The field is layed out on the ground with the rope 14 stretched out in the desired direction of play. The stakes are separated into two groups of six, one for each end of the field. A stake is placed at each marker 54, 56 and 58. Alignment marker straps 20 are also placed on the stretched field extending transversely between markers 58. A stake is secured at markers 58 extending through the loops 64 at either end of the alignment marker straps 20.

As shown in FIG. 6, the baton 12 is utilized to establish the proper field geometry. Taking the handle of the baton and placing it at marker 58 and aligned with the direction of play, the baton is pivoted 90 degrees to the outside. This establishes the location of marker 56. Marker 56 is secured at that location with a stake 16. This procedure is repeated to locate the opposite green marker 56. To determine the placement of blue markers 54, the player pivots the baton 12 three lengths from either red marker in line with the direction of play. The black marker 60 should fall at the end of three lengths of the baton. Secure the stakes 16 at the blue marks.

Figure 7:
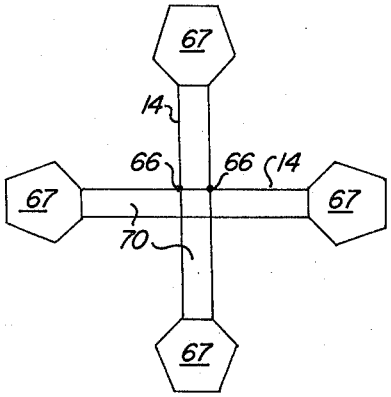
FIG. 7 is a plan view of the field layout for four players.
Figure 8:
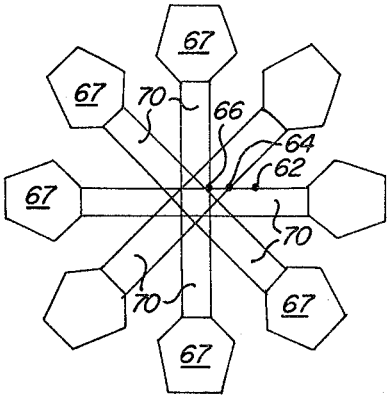
FIG. 8 is a plan view of a field layout for eight players.

This procedure is repeated at the opposite end of the field and the field appears as shown in FIG. 6 having two opposite polygonal areas 67 termed "beaten" zones and an intermediate rectangular area 70 termed a "dead" space. The intermediate color codings or markings 62, 64 and 66 are utilized for establishing multiple field play as shown in FIG. 7 and 8. In the event the game is to be played on soft terrain or sand, the shorter stake 16 can be removed from the nylon rope 52 and replaced with the longer stakes 18. The stakes are conventional having an elongate shank with a pointed lower end and an eyelet or loop 19 at the upper end which may be slid along the length of the rope to an appropriate location.

Figure 4:
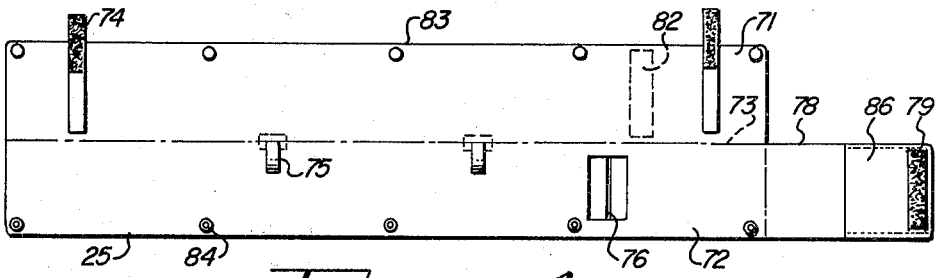
FIG. 4 is a top view of the case or quiver in an open position.

FIGS. 3 and 4 illustrate the quiver or case 25 for convenient storage and transportation of the components of the game illustrated in FIG. 5. Quiver 25 is fabricated from nylon, canvas or other similar material and has panels 71 and 72 joined at fold line 73. Panel 71 carries spaced apart tabs 74 having a loop and pile facing of the type known as "Velcro" for securing the field rope 14 in place. Elastic loops 75 aligned along fold line 73 receive stakes 16. Panel 72 defines an interior pocket opening at 76 for receipt of the baton 12. Flap or panel 78 projects from one end of panel 72 and carries a strip of loop and pile material 79. The outer surface of panel 71 carries a mating strip of loop and pile material 82 to secure flap 78 in the position shown in FIG. 3. Cooperative male and female snap members 83 and 84 are positioned along the outer edges of panels 71 and 72 for securing the panels in the folded position shown in FIG. 3. A carrying handle or strap 85 is secured along the exterior of panels 71 and 72 at the fold line 73. Thus, all of the various components of the game including the field layout rope 14, baton 12 and stake 16 can be accommodated within the case or quiver 25. Flap 78 also carries a small pocket 86 for receipt of rule book 24.

The game or sport of the present invention will be more easily understood from the following description of play. The description will be with reference to the field set-up shown in FIG. 6 for two players. The play begins with each player standing in a beaten zone 67 and each player begins with zero points. A coin toss determines the starting thrower (aggressor). The baton 12 is tossed from one player in his beaten zone 67 to the opponent in his beaten zone 67. The baton 12 must be caught by the handle 34 and tossed underhand, by the handle. When a player obtains ten points that player is eliminated. If the player, in the course of the game, loses the use of both hands the game is terminated. Under other circumstances, the game is won by annihilation of the opponent.

DEFINITIONS

The following definitions will assist in understanding the concept and play of the game:

"Aggressor"—Player with the baton in hand and preparing to throw it to the defender.

"Defender"—Player preparing to catch the baton from the aggressor.

"Good Catch"—A catch of the baton by the defender on the handle with at least one finger width on the handle, and the baton does not touch the surface inside the beaten zone.

"Good Throw"—The baton does not extend over a 180 degree arc on any plane from player to player and strikes within the beaten zone boundaries (except legs).

"Bad Catch"—The failure of the defender to catch the baton with at least one finger width on the handle portion of the baton. Any time the baton touches the body and is not caught. A bad catch also occurs when the baton is allowed to strike the surface after a catch in the beaten zone.

"Bad Throw"—The baton exceeds a 180 degree arc or the baton strikes on or outside the beaten zone boundary lines.

"Null Baton"—A condition at the exact point in time that the baton is no longer valid for producing points or penalties, e.g., a bounce.

"Zone Point"—A tactical course of action of throwing the baton to strike within the defender's beaten zone, thus forcing the defender to move in and around his beaten zone in order to catch the baton. Also it is the point received for stepping on or out of your beaten zone boundary lines.

RULES OF PLAY

1. Basic Facts (a) The arms, wrist to shoulder, are considered neutral during the game. They are not lost by touch of blade.

(b) The baton is considered null upon contact with the surface.

(c) Only one player can be in a beaten zone at any time.

(d) The baton must be tossed, by the handle, underhanded only.

(e) No points are gained for the loss of any limbs, hands or legs.

(f) Only one baton is used during the game.

(g) To gain points, is to lose.

2. How to Lose Generally (a) Ten points. The first player to accumulate ten points is eliminated.

(b) Loss of hands. The first player to lose both right and left hands is terminated.

(c) Total. Annihilated.

3. How to Lose Specifically (a) Ten Points:

1. If the baton flips over a 180 degree arc in any plane this is a bad throw—one point.

2. If the baton strikes surface on or outside beaten zone boundaries upon first contact of surface, this is a bad throw—one point.

3. If the baton strikes surface in beaten zone and is not touched or caught, this is a bad catch—one point.

4. If the baton is touched but not caught, this is a bad catch—one point.

5. If the baton touches beaten zone just as it is caught, this is a bad catch—one point.

6. If a player touches or steps outside his beaten zone while tossing or catching, this is a zone point—one point.

7. If a simultaneous violation of rules occurs, no more than two points can be penalyzed against the violating player.

8. When a total of ten points is penalyzed against one player he is eliminated.

(b) Loss of Hands:

1. The catch of the baton by the defender on the blade without at least one finger width on the handle results in the loss of the option to either catch or toss with that hand for the duration of the game. The arm is placed behind the wounded player's back. No points given.

2. Upon the additional loss of the other hand the player is terminated and the game is over.

(c) Annihilation:

If the blade of the baton touches the head or torso, front or back, of the defender, either during a good catch, bad catch or in his attempt to dodge the baton, the defender is considered annihilated and the game is over.

4. Additonal Rules (a) If the blade portion of the baton touches the legs or feet, either during a good catch, bad catch or the dodge, the defender must then raise the wounded leg when he becomes the aggressor or the defender for the duration of the game. He may rest his leg only after he has thrown the baton and it has passed over the dead space center (black markers). He is obligated to raise the leg again upon warning from the aggressor.

(b) An aggressor tossing the baton to a wounded defender that has lost one or both of his legs must give warning to the defender by lifting the baton by the handle over his head with the tip straight up. The defender is then obligated to raise the wounded leg. If the defender is wounded by the loss of both legs he then raises one arm in acknowledgement of the warning. Should the aggressor fail to warn the defender then the baton is considered null to the defender but all rules apply to the aggressor.

(c) Should the wounded player, with one leg raised, touch the surface during the attempted catch or the throw with that leg to maintain balance he is given one point. He may, however, fall within his beaten zone and not receive a point if he does not fall or step outside the beaten zone.

(d) No points are awarded against the leg wounded defender if the aggressor, during the throw, steps outside the beaten zone and the baton is null at that time.

(e) A player with both legs wounded, must kneel within his beaten zone and remain on his knees for the duration of the game.

(f) An aggressor tossing to a defender that has both legs wounded must throw the baton directly to the defender forcing him to either catch or dodge the baton. The aggressor can not throw just within the defender's beaten zone. The aggressor must also give warning before tossing.

(g) The wounded player with both legs has the option to catch or dodge the baton and allow it to go null within his beaten zone and not attempt a catch. The baton must come directly to him forcing him to catch, or the aggressor receives a bad throw and one point is awarded against the aggressor.

The game may also be played on a multi-field layout using the basic rules outlined above with points awarded for or against teams or individuals as the game progresses.

FIGS. 7 and 8 show the layout for multiple field play. For multiple players, the field can be layed out to accommodate up to twelve players. The markers or indicia 62, 64 and 66 along either side of the dead space 70 assist in setting-up multiple fields. For example, in FIG. 7 a two field set-up is shown. A first field is layed out as has been described before. A second field is layed out perpendicular to the first field with the opposite edges of the dead space 70 extending transversely between the black marker 66 so that a square is formed at the middle of the field.

Similarly, FIG. 8 shows a multiple field layout for eight players using the markers 62, 64 and 66 for alignment purposes.

Figure 9:
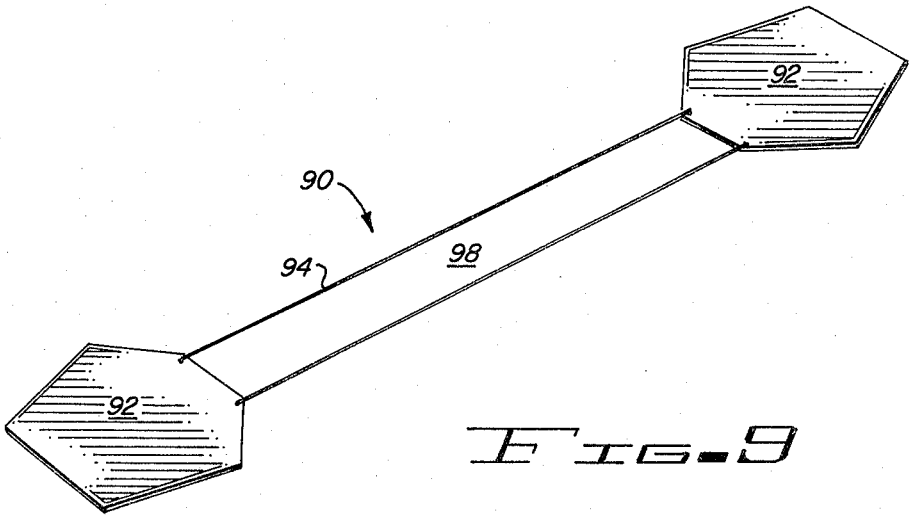
FIG. 9 is a perspective view illustrating a form of the field for indoor use.

FIG. 9 illustrates another form of the field generally indicated by the numeral 90. This form of field is particularly useful for playing the game in gymnasiums and in closed spaces. Field 90 includes two panels polygonally shaped and each defining a beaten zone. The panels may be wood or preferably rubber to minimize slippage. The panels 92 are joined by flexible members 94 which define the dead space area 98. The panels are simply layed out on an appropriate hard surface and extended until the flexible members 94 are taut. In other respects the game is played as described above.

It will be seen from the foregoing that the invention provides a game or sport which can be played under a wide variety of conditions and by participants of all age levels. The game or sport can be a simple throwing game utilizing the baton or can be played as a sophisticated sport using the multiple field layout. The game can be played outdoors or indoors on gymnasium floors and the like.

For some age groups, such as younger players, the additional pad 22 may be placed on the tip end of the blade. Also, the field may be shortened for the younger players. The game teaches skill and develops coordination.

It will be obvious to those skilled in the art to make various modifications, changes and alterations to the embodiments herein described. To the extent that these modifications, changes and alterations do not depart from the spirit and scope of the appended claims, they are intended to be encompassed therein.

I claim:

1. A game piece for a game which is played by manually throwing the game piece between the players, the object of which is to catch the game piece in a prescribed manner, said game piece comprising:

(a) an elongate generally cylindrical body member having opposite first and second ends with the balance point being at the approximate axial midpoint of said body, said body defining a blade area and a handle area, the handle area extending axially along said body from said first end to a terminus along said body and the blade area extending from the terminus of the handle area to said second end;

(b) padding extending about said body in at least the blade area;

(c) a sleeve of a durable fabric encasing said blade area;

(d) a covering extending coextensive with said handle area and defining an axially extending portion by which the piece is to be caught, said handle being devoid of any radially extending projections and being visibly distinctive from said blade area; and (e) protective tip means secured at said first and second ends.

2. The game piece of claim 1 wherein said sleeve is a high visibility color.

* * * * *